US007396109B2

(12) United States Patent
Courian

(10) Patent No.: US 7,396,109 B2
(45) Date of Patent: Jul. 8, 2008

(54) INKJET PRINTING SYSTEM WITH HIGH DROP-WEIGHT YELLOW

(75) Inventor: Kenneth J. Courian, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 424 days.

(21) Appl. No.: 11/261,866

(22) Filed: Oct. 28, 2005

(65) Prior Publication Data

US 2007/0097185 A1 May 3, 2007

(51) Int. Cl.
*B41J 2/21* (2006.01)
*B41J 2/175* (2006.01)

(52) U.S. Cl. ..... 347/43; 347/87

(58) Field of Classification Search ..... 347/5, 347/9, 24, 40, 43, 47, 87
See application file for complete search history.

(56) References Cited

U.S. PATENT DOCUMENTS

| | | | | |
|---|---|---|---|---|
| 4,812,859 | A * | 3/1989 | Chan et al. | 347/63 |
| 5,757,400 | A * | 5/1998 | Hoisington | 347/40 |
| 6,247,798 | B1 * | 6/2001 | Cleland et al. | 347/65 |
| 6,585,343 | B2 * | 7/2003 | Bauer | 347/14 |

* cited by examiner

*Primary Examiner*—Anh T. N. Vo

(57) ABSTRACT

Disclosed are printing systems and printhead assemblies in which yellow print nozzles are paired on a die with black print nozzles, with cyan and magenta print nozzles on a separate die. The pairing of yellow and black nozzles reduces constraints imposed by the printhead architecture and manufacturing processes.

15 Claims, 6 Drawing Sheets

INKJET PRINTING SYSTEM WITH HIGH DROP-WEIGHT YELLOW

FIELD OF INVENTION

This invention relates generally to color inkjet printing systems.

BACKGROUND

Inkjet printing systems are also are well known in the art. Small droplets of liquid ink, propelled by thermal heating, piezoelectric actuators, or some other mechanism, are deposited by a printhead on a print media, such as paper.

In scanning-carriage inkjet printing systems, inkjet printheads are typically mounted on a carriage that is moved back and forth across the print media. As the printheads are moved across the print media, the printheads are activated to deposit or eject ink droplets onto the print media to form text and images. The print media is generally held substantially stationary while the printheads complete a "print swath", typically an inch or less in height; the print media is then advanced between print swaths.

The ink ejection mechanisms of inkjet printheads are typically manufactured in a manner similar to the manufacture of semiconductor integrated circuits. Ink ejection chambers are formed in a printhead die, with a resistor deposited at the base of the mechanism. The resistor, when energized, provides the energy to vaporize a portion of the ink in the chamber, propelling ink out of the chamber and onto a print media.

A tradeoff in the design of printing systems is the choice of drop weights. Lower drop weights tend to result in higher thermal waste due to higher average firing frequency for a given amount of ink, as well as the smaller drop mass available for carrying away heat. Higher drop weights may result in reduced print quality, typically due to the visibility of individual dots. The fabrication processes used in the manufacturing of printhead die constrain the formation of different drop weight ink ejection chambers on a single die.

There is thus a need for apparatus and systems which allow for multiple drop weight printer architectures.

SUMMARY

Exemplary embodiments of the invention include printing systems and printhead assemblies in which yellow print nozzles are paired on a die with black print nozzles, with cyan and magenta print nozzles on a separate die. The pairing of yellow and black nozzles reduces constraints imposed by the printhead architecture and manufacturing processes.

Other aspects and advantages of the present invention will become apparent from the following detailed description, taken in conjunction with the accompanying drawings, illustrating by way of example the principles of the invention.

DESCRIPTION OF EMBODIMENTS OF THE INVENTION

Embodiments of the invention are described with respect to an exemplary "off axis" inkjet printing system; however, embodiments of the invention may be utilized as well in other inkjet systems.

In the following specification, for purposes of explanation, specific details are set forth in order to provide an understanding of the present invention. It will be apparent to one skilled in the art, however, that the present invention may be practiced without these specific details. Reference in the specification to "one embodiment" or "an exemplary embodiment" means that a particular feature, structure, or characteristic described in connection with the embodiment is included in at least one embodiment. The appearance of the phrase "in one embodiment" in various places in the specification do not necessarily refer to the same embodiment.

Figure 1:
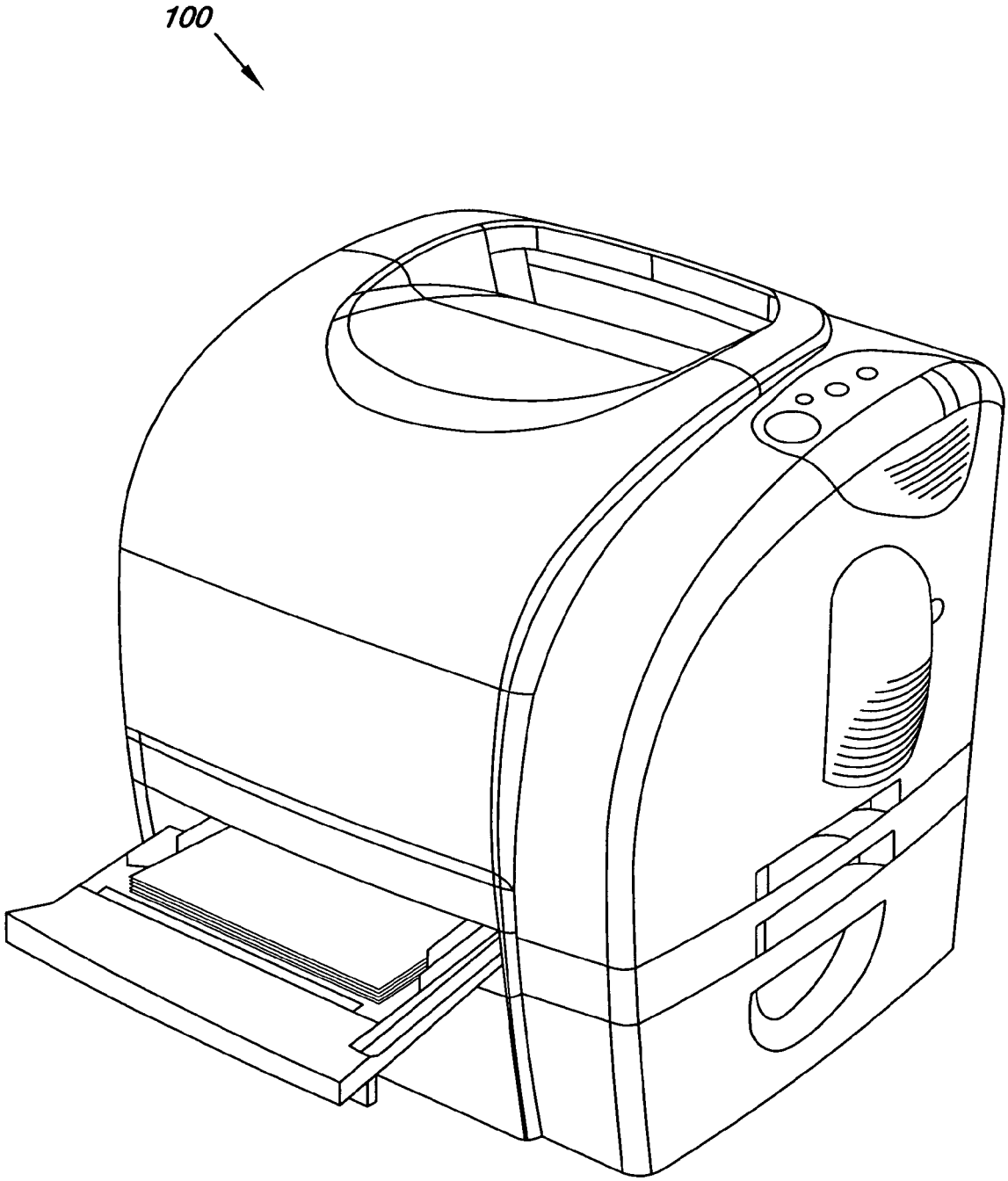
FIG. 1 illustrates an exemplary printing system in which embodiments of the invention may be utilized.

FIG. 1 illustrates an exemplary inkjet printing system 100 in which embodiments of the invention may be utilized. The inkjet printing system of FIG. 1 may be used to print color images, graphics, and text on print media, such as paper. The exemplary printing system may utilize multiple ink colors, such as cyan, magenta, yellow and black; the ink is typically provided in containers that may be replaced by the user when depleted.

Figure 2:
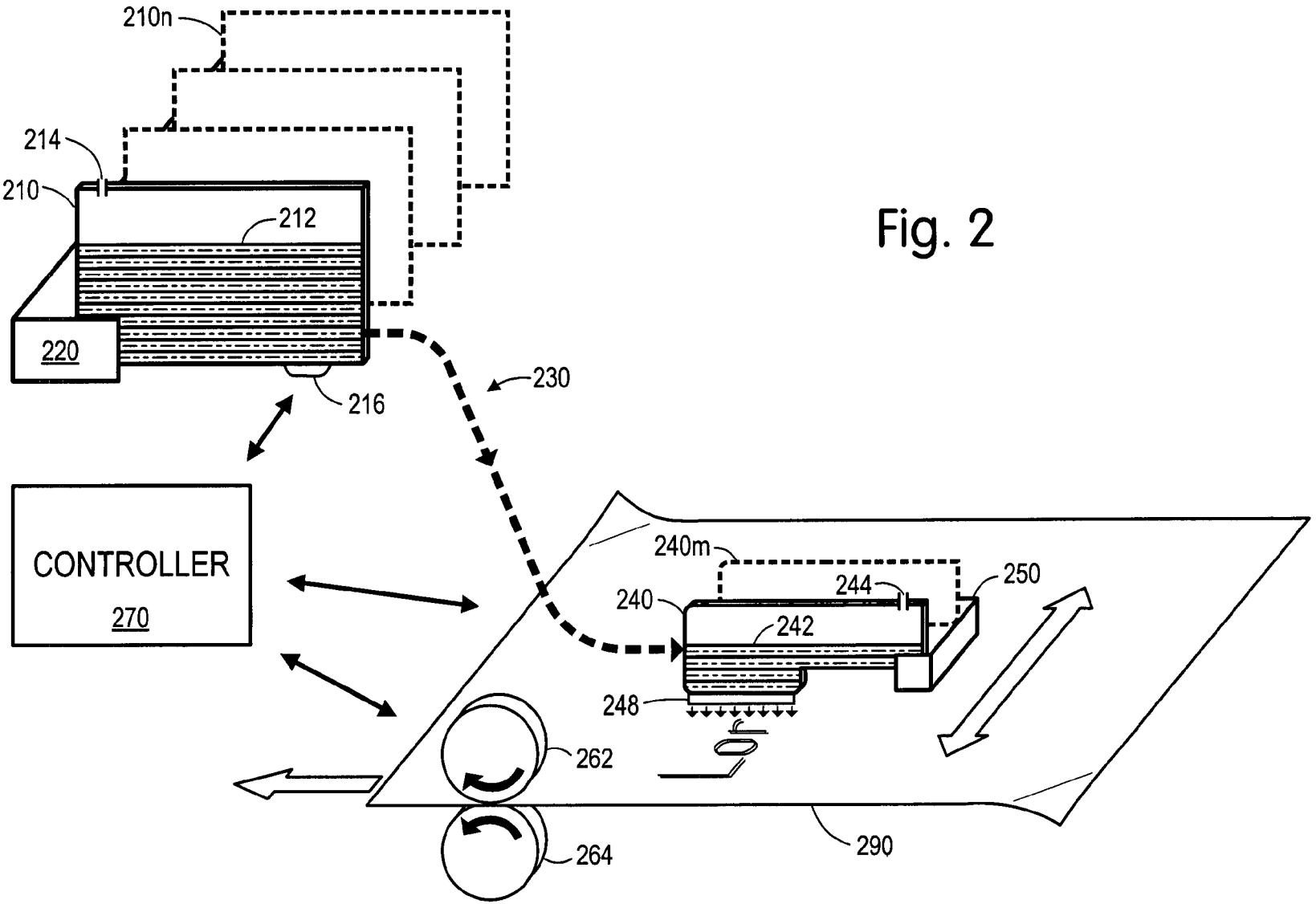
FIG. 2 illustrates the paper path and printhead mechanisms of an exemplary inkjet printing system in which embodiments of the invention may be utilized.

FIG. 2 is an abstracted representation of an exemplary "off-axis" printing system in which embodiments of the present invention may be utilized. The exemplary printing system has at least one replaceable ink supply 210 containing a quantity of ink 212. The exemplary printer may include multiple supplies, such as supplies for each of three primary colors and black, as denoted by phantom lines 210*n* in FIG. 2. The multiple supplies may be housed within a common container or may be independently replaceable, and are typically held in a stationary "off-axis" supply receiving station 220 when installed in the printer. Each replaceable supply 210 may retain the ink 212 in a capillary material (not shown in FIG. 2) such as a foam material, a fibrous material, or other substance; or the supply may contain "free ink" (ink which is not retained in a capillary material). The ink supply may include a venting mechanism 214 to maintain an appropriate pressure relationship between the interior of the supply and the ambient air, or another pressure regulating mechanism known in the art. Other configurations of ink supplies are also known in the art, such as pressurized supplies; the supplies may other supply other fluids to the printheads, such as precoating or over-coating "fixer" fluids.

The replaceable ink supply 210 may also include an integral memory device 216 that is programmed with information pertaining to the ink supply and the printing system. The memory device may include both non-alterable non-volatile memory, as well as memory which may be modified by the printer controller 270 or by the device to which the printer is connected, such as a computer (not shown). The memory device 216 may communicate with the controller 270 or connected device through electrical contacts on the supply that engage mating contacts in the supply receiving station 220 when the supply is installed in the receiving station, or the memory device may communicate through a wireless date link (not shown).

Ink 212 from the supply 210 is provided to a printhead 240 through an ink delivery system 230, which may take many forms (represented in FIG. 2 by a dashed line). For example, the ink delivery system may utilize "trailing tubes," in which flexible tubes connect the chassis-mounted supply the carriage-mounted printhead, or it may entail the intermittent fluidic connection of the printhead and supply. Trailing tube ink delivery systems may provide ink to the printhead through a single tube, with the ink driven through the tube by a pressure differential created by the height of the supply above the printhead or by differential capillary affinities, or may provide for the recirculation of ink through the printhead and back to the supply, with the ink typically driven by a pump. When permanent or semi-permanent printheads are used, ink recirculation can extend the useful lifetimes of the printheads by purging air from the printheads. The ink delivery system may also include one or more pressure regulating devices (not shown), configured to insure the reliable delivery of ink to the printhead. Although described as an "ink delivery system", other fluids may be provided to the printhead, such a fixer fluid.

The ink delivery system 230 may provide ink the printhead 240 on a continuous basis, or may be configured to intermittently refill the printhead during non-printing intervals, receiving ink from the ink delivery system 230 and storing a small quantity of ink 242 in a local reservoir within the printhead assembly.

The exemplary printer may include multiple printheads, such as printheads for the primary colors and for black, as denoted by phantom lines 240*m*. A printhead may include a single row of ink ejection elements for printing a single ink color, or multiple rows of ink ejection elements may be incorporated into a single printhead, with each row printing a different color. The printhead is typically attached to a scanning carriage 250 that reciprocates across the print medium 290. A printhead also typically includes one or more mechanisms for controlling ink backpressure, such that ink does not "drool" from the printhead nozzles. For example, in FIG. 2 the printhead 240 is depicted with a capillary material filling its local ink reservoir, with a vent 244 to maintain a proper pressure relationship with ambient air.

The exemplary printing system of FIG. 2 also has a media handling mechanism, as represented by rollers 262, 264, which move sheets of media 290 through the printer, typically advancing the media by one printhead scan width after each pass of the carriage. Other types of media handling mechanisms and other forms of media may also be used.

A printer controller 270 typically manages all aspects of the printing process, including: controlling and monitoring the scanning carriage 250 and the media handling mechanism 262, 264; receiving print data from an external source such as a computer (not shown in FIG. 2); generating print data and control signals for the printhead; and accessing and storing information on the integral memory device 216.

Figure 3:
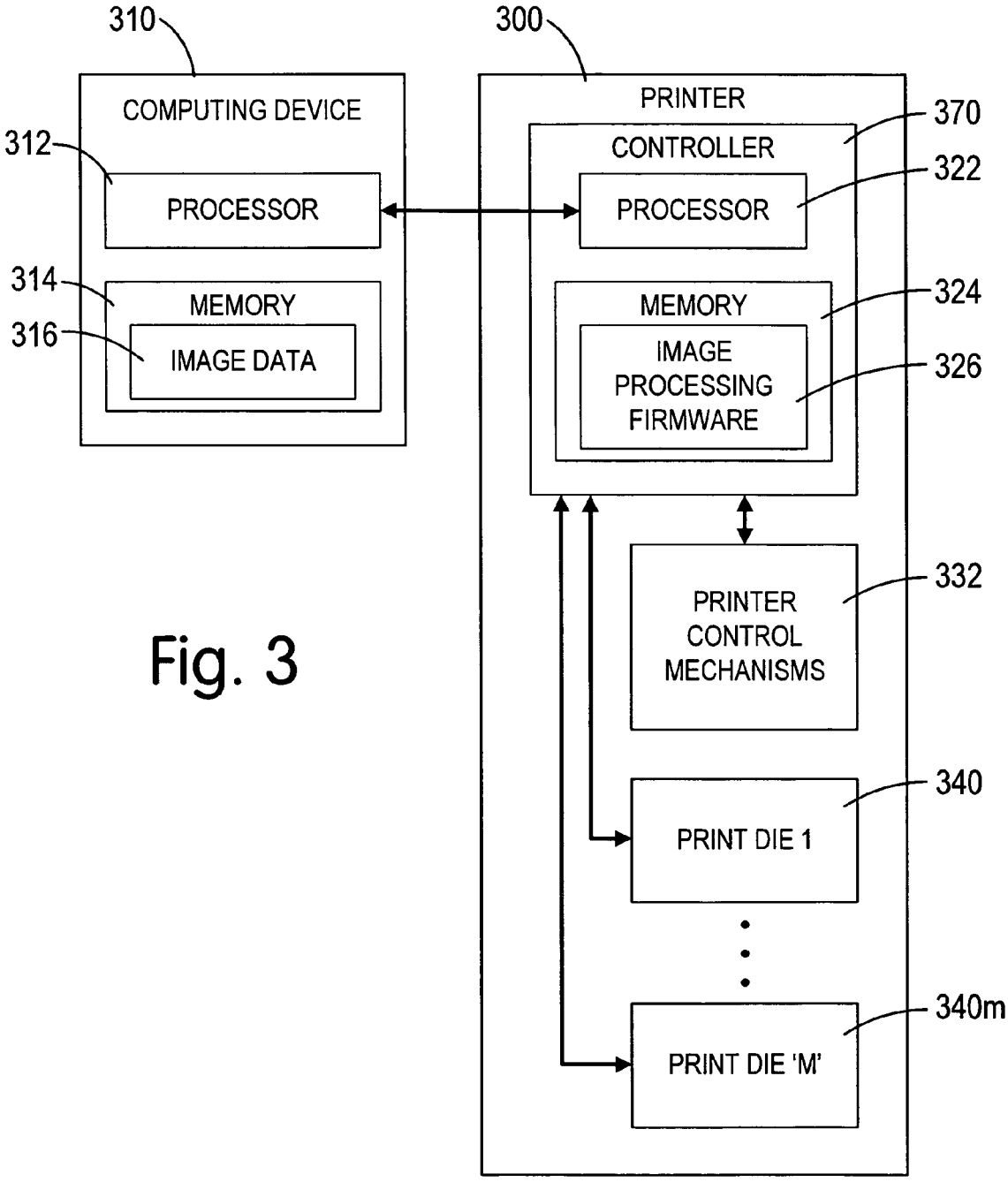
FIG. 3 is a block diagram further illustrating an exemplary system in which embodiments of the invention may be employed.

FIG. 3 is a schematic view of the exemplary inkjet printing system of FIGS. 1 and 2. Computing device 310 may be a computer directly connected to the printing system 300, or there may be multiple computers accessing the printing system over a network, such as a Local Area Network (LAN). Alternatively, some processing capabilities may be incorporated into the printer itself, such as in a photo printer. Computing device 310 typically includes a processor 312 having access to memory 314 including image data 316. The computing device 310 typically formats the image data in a form which may be utilized by printing system 300.

Printing system 300 typically includes a controller 370 which includes a processor 322 having access to memory 324. The memory may include image processing firmware 326 for printing large drop weight yellow images, according to embodiments of the invention.

The controller 370 typically generates print data for the printhead die 340, 340*m* of the printer (two die are illustrated; more die may be employed in some embodiments), and also controls other printer mechanisms 332, such as, for example, controlling the paper feeding mechanism, and the motion of the print carriage (not shown).

Figure 4:
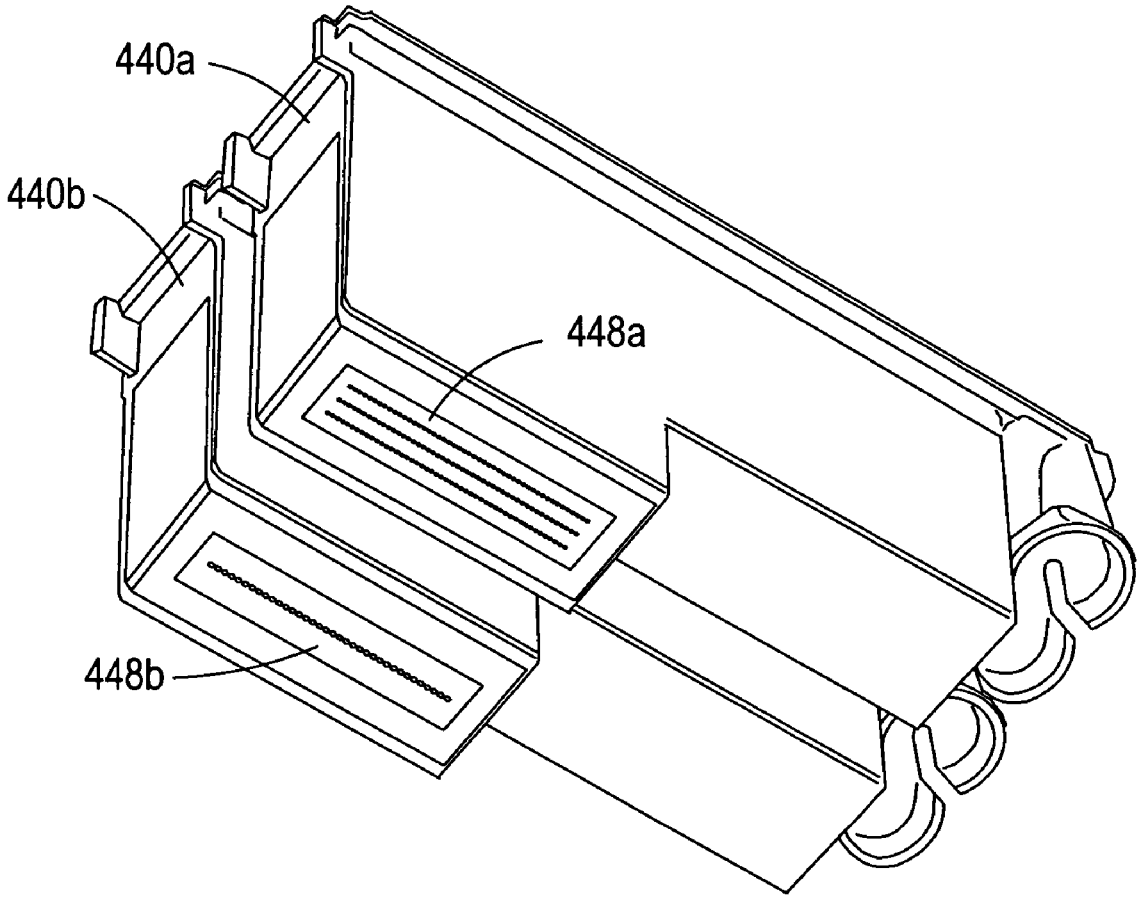
Fig. 4 (Prior Art)
FIG. 4 is a bottom perspective view of a conventional printhead configuration, such as employed in prior art printing systems.

FIG. 4 is a bottom perspective view of a conventional printhead configuration, such as employed in prior art printing systems. Two printhead assemblies 440*a*, 440*b* are shown; printing systems may employ more than two printheads, and may print more than four ink colors. As shown in FIG. 4, printhead 440*a* includes a printhead die 448*a*, which has three rows of print nozzles for printing three ink colors, such as cyan, magenta, and yellow. Printhead 440*b* includes a single row of nozzles for printing black ink.

Typically, the ink ejection chambers of the black printhead die 440*b* are designed to provide a large drop weight relative to the other colors to allow for good text edges and optical density. The cyan, magenta, and yellow ink ejection chambers on the color printhead 440*a* are typically low drop weight to minimize dot visibility which can lead to graininess.

Figure 5:
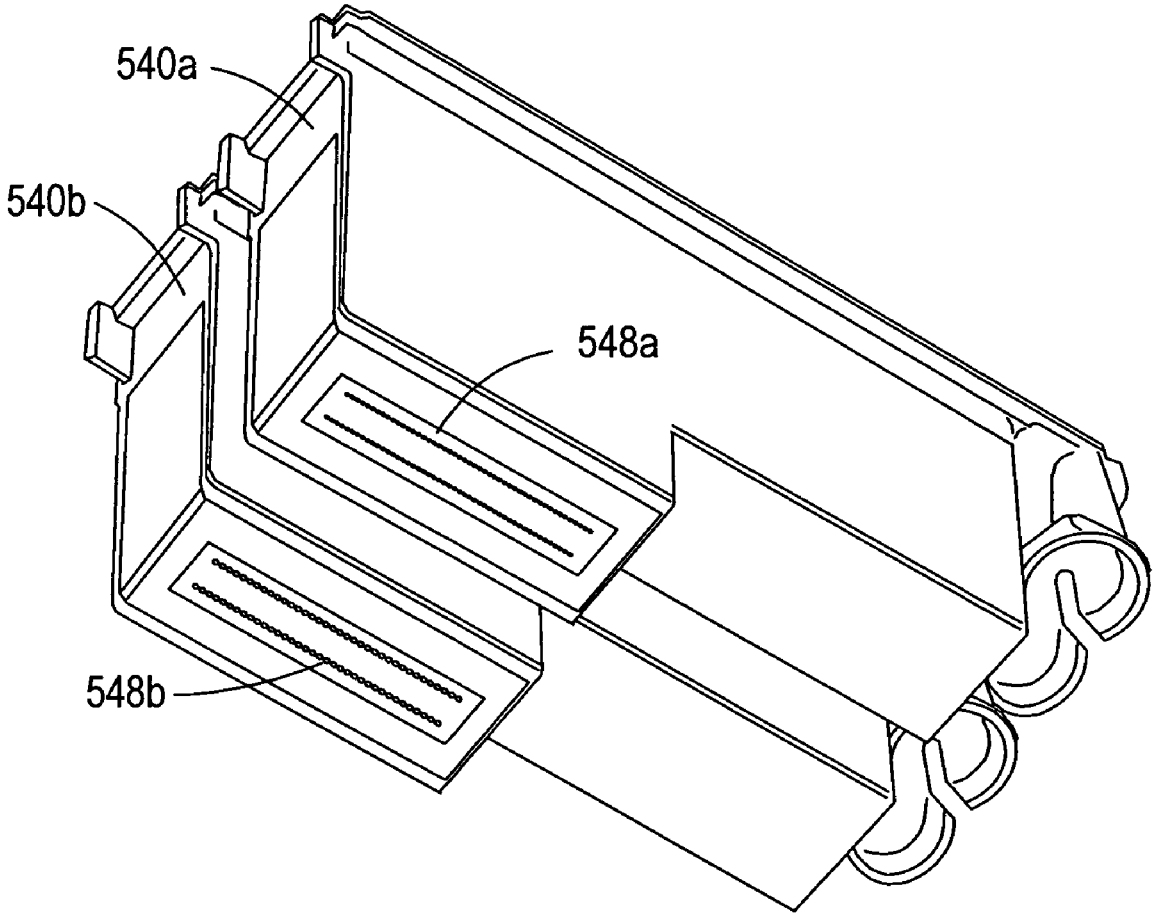
FIG. 5 is a bottom perspective view of a printhead configuration according to an embodiment of the invention.

FIG. 5 is a bottom perspective view of a printhead configuration according to an embodiment of the invention. As shown in FIG. 5, one printhead 540*a* includes a die 548*a* configured to print two colors, such as cyan and magenta. On the other printhead, ink ejection mechanisms are provided for yellow and black. In the image processing firmware of the printer controller, the yellow ink flux is tuned for the best gamut, but its actual dots per pixel count will be lower than the cyan and magenta since each one drop of yellow is larger.

An advantage of the print architecture shown in FIG. 5 is that when a large drop weight black is paired with a large drop weight yellow, the constraints imposed by the fabrication processes are eased. Also, in higher density area fills, the larger yellow drop allows a lower average firing frequency, resulting in less thermal waste to affect the rest of the die, along with the larger drop mass for removing heat.

The processes used to create the ink ejection chambers and nozzles of printheads are typically fairly constrained in the allowable design space. Also, the performance of the ejected drop is influenced by many factors, such as the resistor size, the firing chamber dimensions and the thickness of the different layers forming the ejection chamber. For thermal reasons, it is desirable to use the smallest resistor possible. Also, a larger drop helps carry out more thermal energy. But a smaller resistor with a larger drop has lower drop velocity—velocity matters for vigorous drop ejection. A way to have adequate drop velocity is to have the total firing chamber height (the firing chamber thickness plus the nozzle layer thickness) thinner. Typically, smaller drop weights scale down to a thinner firing chamber height than higher drop weights, though there is some allowable range. Given the constraints imposed by manufacturing processes, the allowable range for firing chamber height on one die is typically insufficient to cover substantially different drop weights; the choice is typically to have inefficient drop ejections from one color or a compromise for other colors on that one die. Using a single drop weight on the one die alleviates the compromise.

Black typically has a higher drop weight since its primary role is in text printing where ink coverage for optical density along with crisp edges are the primary goals. Color drops are typically smaller since less ink is used in any color area fill and the visibility of any dot can lead to grain, an undesirable print artifact. The choice of color to pair with the black, then, may preferably be yellow, since yellow is the least visible color so it would not lead to dot visibility caused grain. In other embodiments where other ink colors are utilized, or in systems using more than four inks, another ink color having low dot visibility may be paired with black.

The embodiment of FIG. 5 thus reduces processing constraints since each die may have a single firing chamber height, and will typically reduce thermal loading caused by the yellow drop ejection, since fewer and larger drops fired for the same ink amount deposition.

Figure 6:
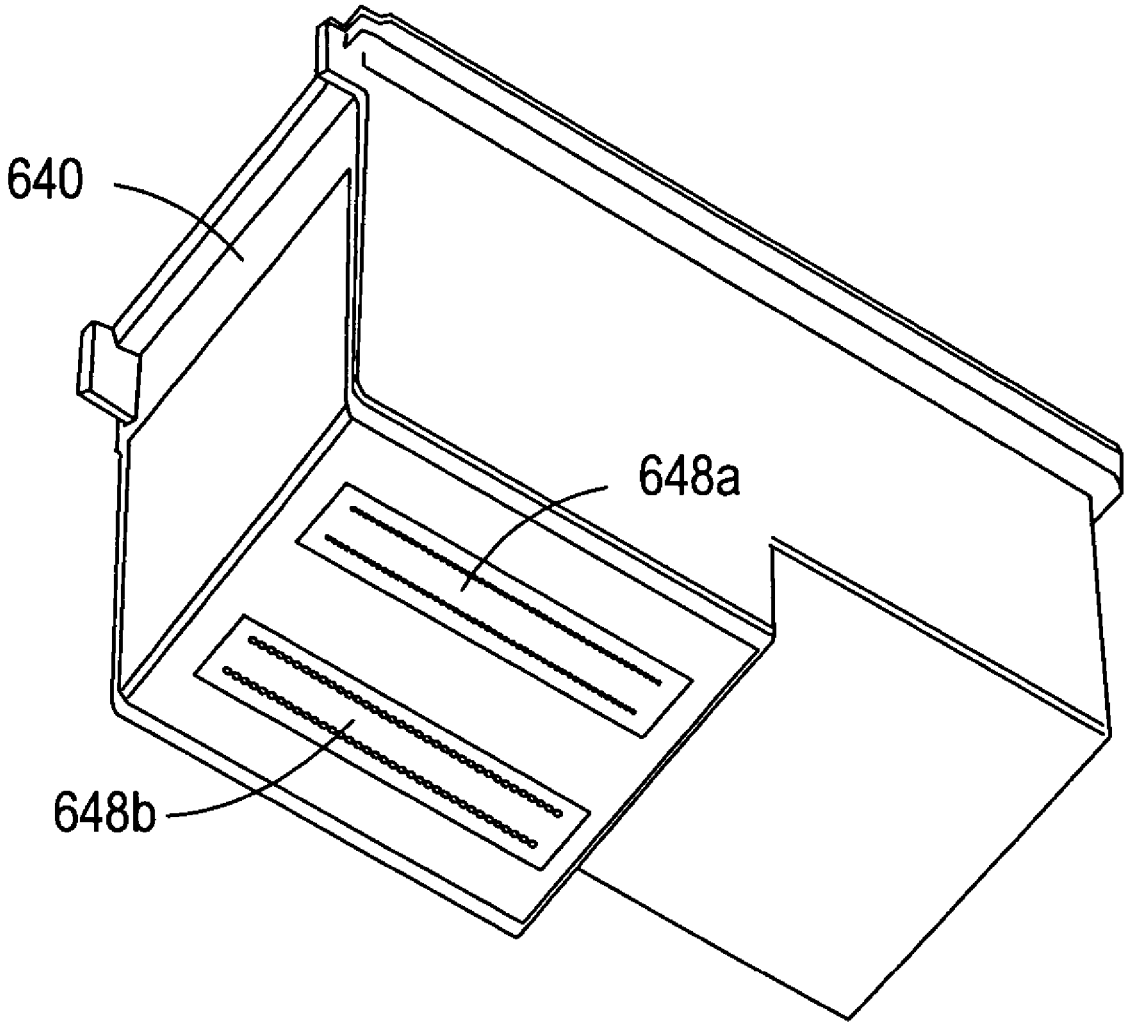
FIG. 6 is a bottom perspective view of a printhead configuration according to a further embodiment of the invention.

FIG. 6 is a bottom perspective view of a printhead configuration according to a further embodiment of the invention. Rather than two separate printhead assemblies, the embodiment of FIG. 6 incorporates both printhead die 648*a*, 648*b* on a single printhead module 640. The embodiment of FIG. 6 may represent a printhead assembly for an "off axis" printing system, or may represent a replaceable print cartridge including an ink supply.

Although described with respect to an exemplary "off axis" printing system, embodiments of the invention also include systems employing print cartridges which incorporate both the printhead and an ink supply in a single replaceable module. Embodiments also include systems employing more than four ink colors, such as, by way of example, systems which also utilize light cyan and light magenta inks.

The above is a detailed description of particular embodiments of the invention. It is recognized that departures from the disclosed embodiments may be within the scope of this invention and that obvious modifications will occur to a person skilled in the art. It is the intent of the applicant that the invention include alternative implementations known in the art that perform the same functions as those disclosed. This specification should not be construed to unduly narrow the full scope of protection to which the invention is entitled.

The corresponding structures, materials, acts, and equivalents of all means or step plus function elements in the claims below are intended to include any structure, material, or acts for performing the functions in combination with other claimed elements as specifically claimed.

What is claimed is:

1. A printing system, comprising:

a first printhead die including print nozzles for multiple color inks;

a second printhead die including print nozzles for a low drop visibility ink and black ink;

and wherein a drop weight of the print nozzles of the second printhead die is larger than a drop weight of the print nozzles of the first printhead die.

2. The printing system of claim 1, wherein the low drop visibility ink comprises yellow ink.

3. The printing system of claim 1, wherein the first printhead die includes print nozzles for cyan and magenta ink.

4. The printing system of claim 1, wherein the first printhead die and the second printhead die are contained on separate printhead assemblies.

5. The printing system of claim 4, further comprising off axis ink containers.

6. The printing system of claim 4, wherein the separate printhead assemblies include integral ink containers.

7. The printing system of claim 1, wherein the first printhead die and the second printhead die are contained on a single printhead assembly.

8. The printing system of claim 7, further comprising off axis ink containers.

9. The printing system of claim 7, wherein the single printhead assemblies include integral ink containers.

10. A printing system, comprising:

a first printhead die including print nozzles for cyan ink and magenta ink;

a second printhead die including print nozzles for a low drop visibility ink and black ink;

and wherein a drop weight of the print nozzles of the second printhead die is larger than a drop weight of the print nozzles of the first printhead die.

11. The printing system of claim 10, wherein the low drop visibility ink is yellow ink.

12. The printing system of claim 10, wherein the first printhead die and the second printhead die are contained on separate printhead assemblies.

13. The printing system of claim 10, wherein the first printhead die and the second printhead die are contained on a single printhead assembly.

14. A printhead assembly for an inkjet printing system, comprising:

a first printhead die including print nozzles for cyan ink and magenta ink;

a second printhead die including print nozzles for yellow ink and black ink;

and wherein a drop weight of the print nozzles of the second printhead die is larger than a drop weight of the print nozzles of the first printhead die.

15. The printhead assembly for an inkjet printing system of claim 14, further comprising integral ink containers.

* * * * *